US010214798B2

(12) United States Patent
Schuh et al.

(10) Patent No.: US 10,214,798 B2
(45) Date of Patent: Feb. 26, 2019

(54) METHOD FOR CONTROLLING THE ENERGY DAMPING OF A SHAPE MEMORY ALLOY WITH SURFACE ROUGHNESS

(71) Applicant: Massachusetts Institute of Technology, Cambridge, MA (US)

(72) Inventors: Christopher Schuh, Wayland, MA (US); Stian Melhus Ueland, Cambridge, MA (US)

(73) Assignee: Massachussetts Institute of Technology, Cambridge, MA (US)

( * ) Notice: Subject to any disclaimer, the term of this patent is extended or adjusted under 35 U.S.C. 154(b) by 41 days.

(21) Appl. No.: 15/036,495

(22) PCT Filed: Nov. 15, 2013

(86) PCT No.: PCT/US2013/070224
§ 371 (c)(1),
(2) Date: May 13, 2016

(87) PCT Pub. No.: WO2015/073016
PCT Pub. Date: May 21, 2015

(65) Prior Publication Data

US 2016/0265089 A1 Sep. 15, 2016

(51) Int. Cl.
*C22C 9/01* (2006.01)
*C22C 9/04* (2006.01)
(Continued)

(52) U.S. Cl.
CPC ..... *C22C 9/04* (2013.01); *C22C 9/01* (2013.01); *C22F 1/08* (2013.01); *C25F 3/22* (2013.01)

(58) Field of Classification Search
CPC ..... C22C 9/09; C22C 9/01; C25F 3/22; C22F 1/08
See application file for complete search history.

(56) References Cited

U.S. PATENT DOCUMENTS 5,863,360 A 1/1999 Wood et al.
6,375,826 B1 4/2002 Wang et al.
(Continued)

FOREIGN PATENT DOCUMENTS

EP 2423388 A1 2/2012

OTHER PUBLICATIONS

M. Chmielus, K. Rolfs, R. Wimpory, W. Reimers, P. Müllner, R. Schneider, Effects of surface roughness and training on the twinning stress of Ni—Mn—Ga single crystals, In Acta Materialia, vol. 58, Issue 11, 2010, pp. 3952-3962, ISSN 1359-6454, https://doi.org/10.1016/j.actamat.2010.03.031.*
(Continued)

*Primary Examiner* — Louis J Rufo
(74) *Attorney, Agent, or Firm* — Theresa A. Lober

(57) ABSTRACT

In a method for controlling energy damping in a shape memory alloy, provided is a shape memory alloy having a composition including at least one of: Cu in at least about 10 wt. %, Fe in at least about 5 wt. %, Au in at least about 5 wt. %, Ag in at least about 5 wt. %, Al in at least about 5 wt. %, In in at least about 5 wt. %, Mn in at least about 5 wt. %, Zn in at least about 5 wt. % and Co in at least about 5 wt. %. The shape memory alloy is configured into a structure including a structural feature having a surface roughness and having a feature extent that is greater than about 1 micron and less than about 1 millimeter. Energy damping of the structural feature is modified by exposing the structural feature to process conditions that alter the surface roughness of the structural feature.

10 Claims, 6 Drawing Sheets

(51) Int. Cl.
*C22F 1/08* (2006.01)
*C25F 3/22* (2006.01)

(56) References Cited

U.S. PATENT DOCUMENTS

| | | | | |
|---|---|---|---|---|
| 6,569,193 | B1 | 5/2003 | Cox et al. | |
| 7,544,257 | B2 | 6/2009 | Johnson et al. | |
| 8,216,396 | B2 | 7/2012 | Dooley et al. | |
| 8,282,746 | B2 | 10/2012 | Schuh et al. | |
| 9,018,117 | B2 | 4/2015 | Schuh et al. | |
| 9,091,314 | B2 | 7/2015 | Schuh et al. | |
| 9,512,039 | B2 | 12/2016 | Schuh et al. | |
| 2003/0208263 | A1 | 11/2003 | Burmeister et al. | |
| 2007/0137740 | A1* | 6/2007 | Johnson | A61L 31/022 148/562 |
| 2012/0318101 | A1 | 12/2012 | Johnson et al. | |
| 2014/0255693 | A1 | 9/2014 | Schuh et al. | |
| 2015/0337420 | A1 | 11/2015 | Schuh et al. | |
| 2016/0265089 | A1 | 9/2016 | Schuh et al. | |

OTHER PUBLICATIONS

Stian M. Ueland, Christopher A. Schuh "Superelasticity and fatigue in oligocrystalline shape memory alloy microwires", Acta Materialia 60 (2012) 282-292.*

Safaa N. Saud, E. Hamzah, T. Abubakar, and S. Farahany, "Structure-Property Relationship of Cu—Al—Ni—Fe Shape Memory Alloys in Different Quenching Media", JMEPEG (2014) 23:255-261, DOI: 10.1007/s11665-013-0759-9 (Year: 2013).*

PCT/US2013/070224, International Search Report, Form PCT/ISA/210 first sheet, second sheet, continuation of second sheet, and patent family annex, May 2015.

PCT/US2013/070224, PCT Written Opinion of the International Searching Authority, Form PCT/ISA/237 Cover Sheet, Box No. I/Box V sheet, and Separate sheets 1-2, dated May 2016.

JP Application No. 2016-531667, JPO Communication—English, Jul. 2017.

Wu et al., "In situ characterization of NiTi based shape memory thin films by optical measurement," Smart Materials and Structures, vol. 15, No. 2, pp. N29-N35, Jan. 2006.

Adiguzel, "Smart materials and the influence of atom sizes on martensite microstructures in copper-based shape memory alloys," Jnl. Materials Processing Tech., vol. 185, pp. 120-124, 2006.

Chen et al., "Size effects in shape memory alloy microwires," Acta Materialia, vol. 59, pp. 537-553, Oct. 2010.

Chen et al., Shape memory and superelasticity in polycrystalline Cu—Al—Ni microwires, Appl. Phys. Letts., vol. 95, pp. 171906 1-171906 3, Oct. 2009.

Miyazaki et al., "The Fraction of Cu—Al—Ni Shape Memory Alloy," Trans. Japan Inst. of Metals, vol. 22, No. 4, pp. 244-252, 1981.

Olender, "Strain Rate Effects on the Behavior of Shape Memory Alloys," Massachusetts Institute of Technology Bachelor of Science Thesis, Dept. of Materials Sci. and Eng. Jun. 2013.

Perkins et al., Stress-Induced Martensitic Transformation Cycling and Two-Way Shape Memory Training in Cu—Zn—A Alloys, Metallurgical Trans. A, vol. 15A, pp. 313-321, Feb. 1984.

Simka et al., "Electropolishing and passivation of NiTi shape memory alloy," Electrochimica Acta, vol. 55, pp. 2437-2441, Dec. 2009.

Ueland et al., "Transition from many domain to single domain martensite morphology in small-scale shape memory alloys," Acta Materialia, vol. 61, pp. 5618-5625, Jul. 2013.

Ueland et al., "Oligocrystalline Shape Memory Alloys," Adv. Funct. Mater., pp. 1-6, Mar. 2012.

Ueland et al., "Grain boundary and triple junction constraints during martensitic transformation in shape memory alloys," J. Appl. Phys., vol. 114, pp. 053503-1-083503-11, Aug. 2013.

* cited by examiner

FIG. 3A
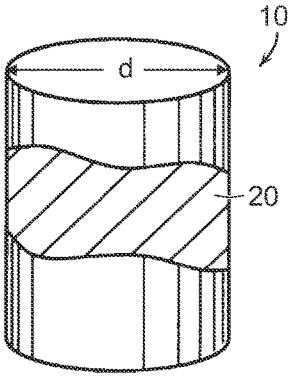
FIG. 3E
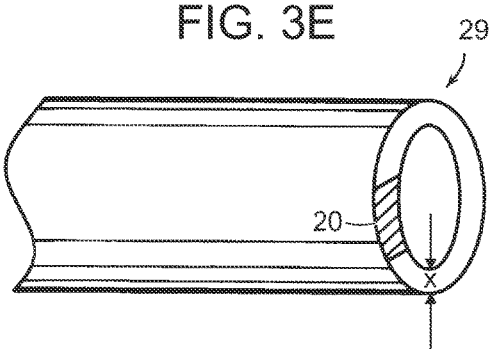
FIG. 3B
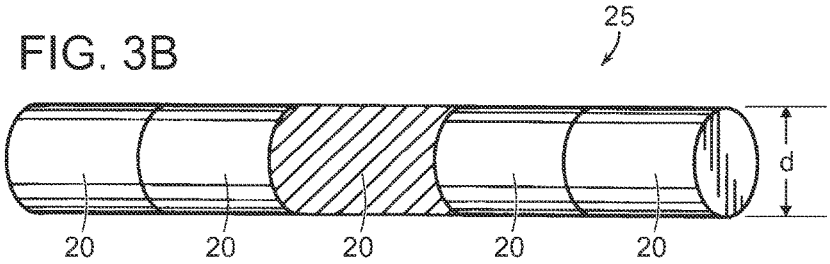
FIG. 3C
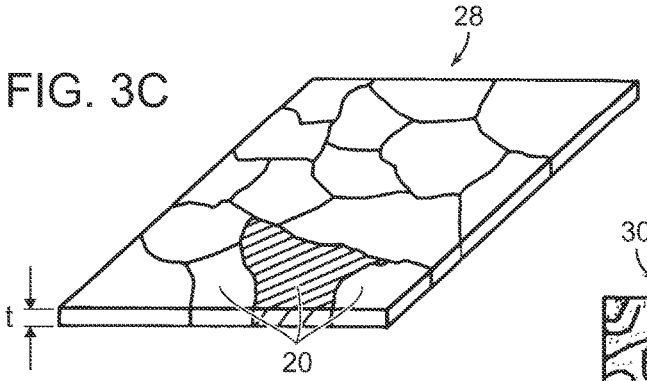
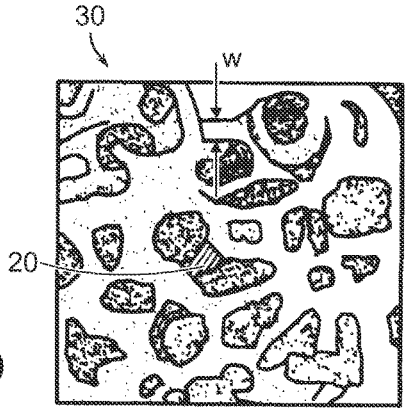
FIG. 3D

METHOD FOR CONTROLLING THE ENERGY DAMPING OF A SHAPE MEMORY ALLOY WITH SURFACE ROUGHNESS

STATEMENT REGARDING FEDERALLY SPONSORED RESEARCH

This invention was made with Government support under Contract W911NF-07-D-0004, awarded by the Army Research Office. The Government has certain rights in the invention.

BACKGROUND

This invention relates generally to functional materials, such as shape memory alloys, and more particularly relates to control of energy dissipation in a superelastic shape memory alloy structure.

The degree of energy dissipation, or energy damping, in a functional material, such as a shape memory alloy (SMA), has important practical implications for many SMA devices and systems. For a wide range of SMA applications a high degree of damping can be desired, e.g., for enabling impact absorption and vibration control. In contrast, in other SMA applications, including mechanical actuation and energy harvesting, energy damping can be undesirable. Aside from this consideration for energy dissipation, the design specifications for a SMA application as a whole or a SMA active element in an application system can otherwise be similar. For example, a SMA wire element design that is designed for actuating the movement of a mirror is can also operate in a woven fabric that is designed dissipating energy from the vibrations in an engine mount.

Shape memory alloys are characterized by a solid-to-solid reversible phase transformation between a higher temperature phase, called austenite, and a lower temperature phase, called martensite. The alloy crystal structure of the austenitic phase is typically a cubic superlattice, while the alloy crystal structure of the martensitic phase is monoclinic or orthorhombic. The transformation of the alloy material between these two phases results in recoverable strains on the order of 6-10%. During such a so-called martensitic transformation, energy is dissipated as heat; the amount of this energy dissipation is reflected in the degree of hysteresis in a phase transformation cycle: the larger the phase transformation cycle hysteresis the more energy is dissipated by the phase transformation cycle. As a result, the amount of energy damping produced by a shape memory alloy structure in a phase transformation cycle can be measured by the size of the hysteresis in a stress-strain curve for a phase transformation cycle that is obtained during an observed mechanical phase transformation of the structure.

For a range of SMA applications a large hysteresis can be desirable, e.g., for applications in which the function of the SMA is to damp vibrational energy. In such applications for which energy dissipation is desirable, a SMA material element can be correspondingly engineered to damp mechanical energy. But although a SMA damping design can in general be effective, it typically requires a trade-off with other SMA material properties, such as mechanical fatigue and corrosion resistance. Similarly, a SMA material element can be engineered to produce relatively low mechanical damping, but also at a trade-off with other SMA material properties, such as temperature sensitivity, mechanical stresses, cost, or manufacturability. Due to these inherent trade-offs required in the design of a SMA material element with a selected degree of damping, control of SMA material element damping is often impractical, and results in a common SMA material element design being employed for both high-damping and low-damping applications; e.g., with a substantially identical SMA element design being employed for both for actuating structures and for energy dissipating structures.

The trade-offs required for achieving a particular, pre-specified degree of energy damping are particularly large for microscale and nanoscale SMA structures having SMA material element dimensions in the microscale or nanoscale. For such SMA structures, the material requirements set by operational and performance considerations can be very stringent. In particular, the compromises that are often required for achieving various small-scale operational performance can result in an inability to selectively control energy damping by the SMA structure. As a result, microscale and nanoscale SMA material structures can be severely limited in meeting specific energy damping requirements given for microscale and nanoscale SMA applications.

SUMMARY

To enable the ability to tailor a SMA structure for meeting specific energy damping requirements there is provided a method for controlling energy damping in a shape memory alloy. In the method, there is provided a shape memory alloy having a composition that includes at least one member selected from the group consisting of Cu in at least about 10 wt. %, Fe in at least about 5 wt. %, Au in at least about 5 wt. %, Ag in at least about 5 wt. %, Al in at least about 5 wt. %, In in at least about 5 wt. %, Mn in at least about 5 wt. %, Zn in at least about 5 wt. % and Co in at least about 5 wt. %. The shape memory alloy is configured into a structure that includes a structural feature having a feature extent that is greater than about 1 micron and less than about 1 millimeter. The shape memory alloy structural feature is characterized as having a surface roughness.

The energy damping of the shape memory alloy structural feature is modified by exposing the shape memory alloy structural feature to process conditions that alter the surface roughness of the shape memory alloy structural feature. Such surface roughness tuning is employed to control the desired amount of energy to be dissipated by the structure during a superelastic transformation cycle. This control of energy damping can be used in a variety of applications to enable optimal performance of smart materials in actuation, mechanical vibration control, energy harvesting, and other applications. Other features and advantages of the energy damping control method will be apparent from the following description and accompanying figures, and from the claims.

DESCRIPTION OF THE DRAWINGS

FIGS. 3A-3E are schematic views of an example superelastic alloy micro-pillar, wire or fiber, planar structure, open-cell foam shape, and tube, respectively, having surfaces that can be modified as provided herein;

DETAILED DESCRIPTION

Figure 1A:
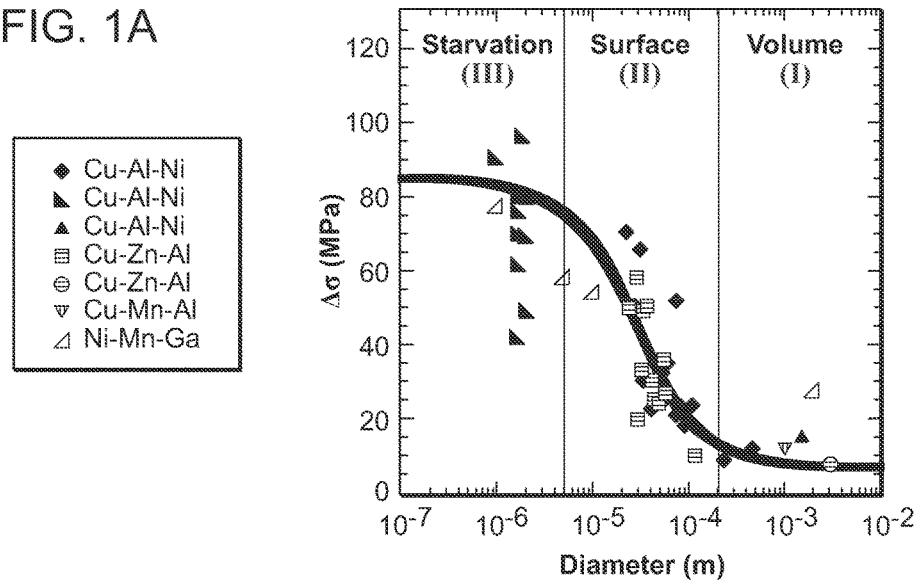
FIG. 1A is a plot of stress hysteresis, $\Delta\sigma$, or amount of energy dissipated for a SMA martensitic transformation cycle that is measured for martensitic transformation of a SMA wire as a function of wire diameter, identifying a size regime in which volume effects dominate (I), a size regime in which surface effects dominate (II), and a size regime in which surface and volume effects are starved and size dominates (III)

The energy dissipation, or energy damping, characteristics of a superelastic structure, such as a shape memory alloy (SMA) structure, are influenced by surface and volume effects of the SMA structure, with three distinct size regimes of influence being distinguishable. Herein is provided a methodology for the particular tuning of SMA energy damping by control of surface effects in a corresponding one of the distinct size regimes. Referring to FIG. 1A, this size influence is illustrated in an example plot of stress hysteresis, $\Delta\sigma$, or amount of energy dissipated for a cycle of SMA austenite-martensite phase transformation, as a function of the size of a SMA structure feature, here the diameter of SMA wires. In this example, measured data from Cu-based SMA wires is presented, specifically for Cu—Zn—Al and Cu-al-Ni systems, but the general relationship is not limited to Cu-based SMA wires and is applicable in general to SMA structures.

In a first size regime (I), bulk effects of the SMA material, i.e., in the material volume, such as volume defects, influence the stress hysteresis of the SMA structure and result in relatively low stress hysteresis and low energy damping for a SMA structure extent above the regime I lower size threshold. In a second size regime (II), surface effects of the SMA structure, such as surface roughness, impact the mechanical response of the structure, and in this regime, as the structure feature size is reduced, stress hysteresis and energy damping increases. In a third regime (III), below a characteristic feature size threshold, the scale of the SMA structure dominates, and starvation of surface defects occurs. This third regime is characterized by a relatively high stress hysteresis and high energy damping.

In the experimental data of the plot of FIG. 1A, relating to Cu-based SMA alloy wires, the first, volume-dominated size regime (I), occurs at SMA feature sizes greater than about 500 μm. The second, surface-dominated size regime (II) occurs at SMA feature sizes between about 1 μm and about 500 μm. The third, size-dominated regime (III) occurs at SMA feature sizes less than about 1 μm. These particular regime thresholds are specific to this Cu-based SMA alloy wire example only, but demonstrate the three size-based regimes that are applicable to SMA structures in general.

It is discovered herein that for the surface-dominated feature size regime (II) of a SMA structure, control of the surface finish of the structure can be particularly specified to produce a corresponding energy damping characteristic for the structure. During a martensitic transformation cycle in a SMA structure, frictional energy is dissipated as heat when the austenite/martensite interface moves past obstacles within the SMA structure and at the structure surface. The vertical extent of the hysteresis loop that is characteristic of the transformation cycle, i.e., the height of the loop formed in a plot of stress as a function of applied strain of an austenite-martensite superelastic transformation cycle is proportional to the amount of energy dissipated in the cycle, which is the energy that is damped in the cycle. In an SMA structure having at least one structural feature with a length, or extent, that falls within the surface-dominated regime (II) of size for that particular SMA structure, obstacles at the surface of the structure can be a dominant source of energy damping during the transformation cycle. For such structures in this surface-dominated regime, the amount of energy dissipated in one superelastic cycle is intimately linked to the surface finish of the structure.

By controlling the surface roughness of such structures, both the size of the population of surface obstacles as well as the frictional potential of the surface obstacles can be tuned. For example, by smoothing a SMA structure surface, the number of obstacles at the surface can be reduced, such that fewer surface obstacles exist for encounter with the austenite/martensite interface movement during a phase transformation, with a corresponding reduction in energy dissipation during the transformation. Alternatively, by roughening a SMA structure surface, the number of obstacles at the surface can be increased, such that more surface obstacles exist for encounter with the austenite/martensite interface movement during a phase transformation, with a corresponding increase in energy dissipation during the transformation. Such surface tuning is employed to control the desired amount of energy to be dissipated by the structure during a superelastic transformation cycle. As explained in detail below, this method of controlling damping can be used in a variety of applications to enable optimal performance of smart materials in actuation, mechanical vibration control, energy harvesting, and other applications.

For SMA structures in the volume-dominated size regime (I), having a larger feature size than that in the surface-dominated size regime (II), the surface-to-volume ratio is too small for the surface finish of the structure to play any important role in the energy dissipation during a superelastic transformation cycle. On the other hand, for very small SMA structures, in the third size regime (III), surface obstacles are in general too few and far between to be the dominant source of energy dissipation; instead the mechanical behavior of the SMA structure during a superelastic transformation is here controlled by defect probability. As a result, damping performance is dominated by surface condition only for SMA structures having a feature with a length scale in the surface-dominated energy dissipation size regime (II) that is characteristic of that structure. For the example Cu-based SMA structure represented by the data plot in FIG. 1A, that characteristic regime is between about 1 μm and about 500 μm.

This surface-dominated energy dissipation regime (II) can be determined for any SMA structure to ascertain the size range of structural features for which the state of the structure surface can be tuned to control the energy damping of the structure during a superelastic transformation cycle. To make this determination of the surface-dominated energy dissipation regime for a selected SMA structure, there can be employed any suitable analysis or technique, including empirical and experimental techniques.

In general, a surface-dominated size regime can be characterized, that is, can be well-defined, for a SMA structure having a surface area that is large relative to the structure's volume and/or for a SMA structure that includes structural defects having an average, or characteristic defect size that is small relative to the volume of the SMA structure. Structural defects can include, e.g., dislocations, dislocation tangles, vacancies, inclusions, second phases, and other such features, and can vary from SMA material to SMA material. For many materials, such defects have characteristic sizes or size ranges. For SMA structures including defects the size of which are small relative to the SMA structure volume, a surface-dominated size regime can in general be determined for the SMA structure. Measurement techniques that enable the determination of such defect size relative to structure volume can therefore be conducted to confirm a surface-dominated size regime for a given SMA structure. Analysis of a structure surface area relative to structure volume can also be conducted to confirm a surface-dominated size regime for a given SMA structure.

Additional analysis and techniques can be employed to confirm a surface-dominated size regime for a given SMA structure. For example, if a correlation between surface-to-volume ratio of the SMA structure and some mechanical property, like damping, is observed, then the structure does have a surface-dominated size regime and the approximate range of that regime can be determined. Experimentally, a given SMA structure can be cut in half and the surface of one half either polished or roughened relative to the surface of the other half, so that the two halves possess similar properties but different surface roughnesses. The mechanical response of superelastic martensitic cycling of the two samples reveals if the structure is in a surface-dominated size regime: If the hysteresis of the martensitic cycling of the two samples differs greatly between the two samples, then the structure size is in the surface-dominated regime, while if the hysteresis is similar for the two samples is similar then the structure size is not in the surface dominated regime.

In one example of experimental testing, multiple samples of a selected SMA structure design, such as a SMA wire, are produced with a range of feature sizes that could be within the surface-dominated size regime, e.g., a range of SMA wire diameters. The SMA samples preferably all have common characteristics other than feature size, and preferably have substantially identical surface condition, including surface roughness. The selected feature size is then adjusted for each of the SMA samples. In SMA materials including Cu, the surface-dominated size regime has been established, as shown in FIG. 1, to be between about 10 microns and about 200 microns, and such can be confirmed for a given Cu-based SMA structure by producing samples having feature sizes within and around this range. For other alloy systems, feature sizes around this range of between about 10 microns and about 200 microns can also be produced for initial analysis. For some SMA structure sizes, review of published literature can be preferred to initially confirm that a surface-dominated size regime exists for the SMA material and structure, and to ascertain general expectations for the surface-dominated size regime size boundaries.

After initial analysis, a specific range of feature sizes can be experimentally tested to determine the boundaries of the surface-dominated size regime. The size interval between sizes of different samples produced for experiment can be set based on the accuracy required for a given application. For example, feature size intervals of 10 microns can be employed as a starting point. The number of different feature size samples to be produced is therefore also set based on the accuracy required for a given application. At least about five samples, e.g., 10 or more samples, can be employed as-needed for a given application. The produced samples are then each exposed to a known strain that causes martensitic transformation, and one or more transformation cycles are imposed, with the energy damping of each cycle measured. Each of the three size regimes like those shown in the plot of FIG. 1A can then be identified. The surface-dominated size regime is that range of feature sizes for which the transformation cycle energy damping shows a dependence of the degree of energy damping on the feature size. The other size regimes I and III are not characterized by a dependence of transformation cycle energy damping on feature size; as shown in the example plot of FIG. 1A, in regimes I and III the energy damping is relatively constant for any feature size. The feature size boundaries between regimes I and II and between regimes II and III can therefore be determined by testing samples having feature sizes that produce conditions of energy damping dependence on feature size and energy damping independence of feature size.

Once a given SMA structure is characterized to identify the three size regimes for that structure, the surface-dominated size regime can be further characterized. In particular, it can be preferred for a selected SMA structure to determine the particular functional relationship that exists for that SMA structure between the degree of surface roughness of the structure and the martensitic transformational energy damping produced for that surface roughness. In one experimental technique to determine such, multiple samples of the selected SMA structure can be fabricated including a common structural feature having a size extent that is within the surface-dominated size regime identified for the SMA structure. Each sample is processed to possess a different, known surface roughness while the other physical properties of the structure are maintained equal. For example, the surface roughness of each in a set of multiple SMA wires can be modified to result in a surface roughness that is between about 1 nm and about 500 nm, with samples having differing degrees of roughness at roughness intervals of, e.g., 50 nm. Mechanical testing of the wires with different surface roughness can then be conducted by, e.g., applying a known strain to each sample and measuring the stress hysteresis of the sample during one or more superelastic transformation cycles. Measurement of the stress hysteresis, corresponding to energy damping, of each of the samples, establishes the relationship between hysteresis size and surface roughness for the surface-dominated size regime of the structure.

Figure 1B:
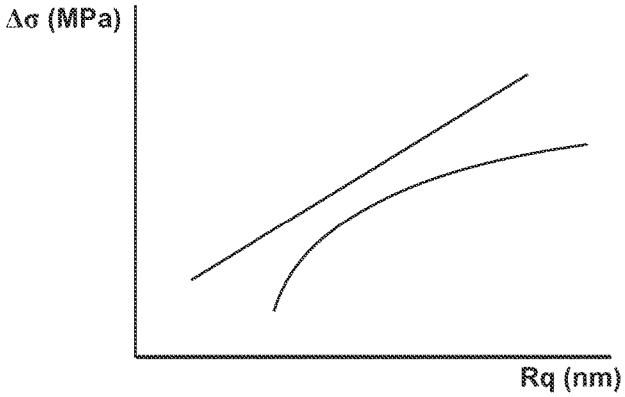
FIG. 1B shows two plotted example relationships between energy damping and surface roughness, shown as stress hysteresis, $\Delta\sigma$, as a function of SMA structure surface roughness.

FIG. 1B includes two example plotted relationships between energy damping and surface roughness, shown as stress hysteresis, $\Delta\sigma$, or amount of energy dissipated for a transformation cycle, as a function of surface roughness, $R_q$. The relationships shown here are only schematic in nature; in general, a given SMA material, structural arrangement, and surface condition results in a distinct, different form of the relationship. But whatever particular relationship form exists for a given SMA structure and surface roughness, it is understood that the relationship is monotonically increasing, i.e., a larger surface roughness leads to more or the same damping as that produced by smaller surface roughness. A reduction in the surface roughness of a SMA structural feature in the surface-dominated size regime results in a reduction in energy damping by the structure during a martensitic transformation cycle, as shown in the plots. Again, it is recognized that the relationship between energy damping and surface roughness can be different for distinct SMA materials and structural arrangements, and no one relationship can be applicable in general. It can therefore be preferred for a given SMA material and/or structural feature configuration to characterize the material and feature to determine the particular correspondence between energy damping and surface roughness for that SMA material and feature.

With such a relationship established, there can a priori be prespecified a desired degree of energy damping for the SMA structure for an intended application and the surface of the structure suitably processed with a surface roughness that produces the prespecified damping. Relationships like those plotted in FIG. 1B can be implemented in hardware or software to enable automatic determination of a required surface roughness for achieving a desired degree of energy dissipation. For example, given a SMA structure having a structural feature in the surface-dominated energy damping regime, the structure can be exposed to selected process conditions that modify the surface roughness to an amount of roughness that is specified by the determined relationship to provide a preselected energy damping. For example, the surface roughness of the structure can be decreased, for example by polishing the SMA structure, to achieve some relatively low degree of energy damping. Such a condition is desirable, for example, for SMA actuator applications in which small energy losses and long fatigue life are required. The surface roughness alternatively can be increased by an appropriate surface modification technique to achieve some specified relatively large degree of energy damping. Such a condition is desirable, for example, for SMA devices purposed to damp energy of, e.g., mechanical vibrations, impact, or sound. Thus, once a direct relationship between surface roughness and surface-dominated energy damping is fully characterized for a given SMA material structure, the SMA material structure can be engineered to produce a prespecified degree of energy damping. The SMA material structure can then be employed in a wide range of applications with differing energy damping requirements by correspondingly controlling the surface roughness based on the energy damping characteristic.

Figure 2:
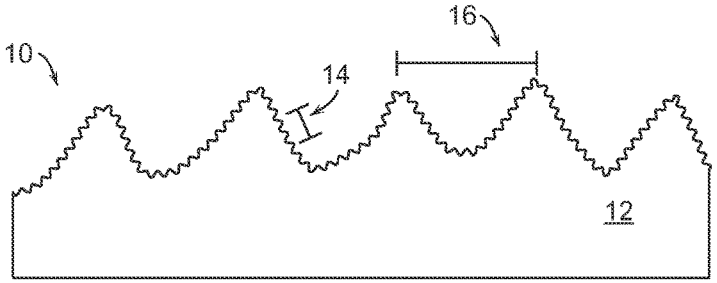
FIG. 2 is a schematic side view of a SMA structure having a surface with two different scales of surface roughness.

In control of a SMA structure surface to produce a prespecified degree of energy damping the structure surface can be processed to take on a uniform condition across the structure surface, or can include a customized surface topology having multiple layers of surface roughness features that are each on a different size scale. Such topology customization can be employed, e.g., to enable control of both energy damping and one or more other mechanical properties. For example, for an SMA application requiring a high degree of energy damping as well as extended fatigue life, the SMA structure's surface roughness can be tuned to meet both goals by introducing two levels of roughness, one microscopic, or local, and one macroscopic, or global. FIG. 2 schematically illustrates an example of such a modulated surface 10 of a superelastic SMA structure 12. On a relatively small size scale, 14, the structure 12 exhibits a first surface roughness extent, while on a relatively larger scale, 16 the structure exhibits a second surface roughness extent.

In the example provided in FIG. 2 the local-scale surface roughness, which in general impacts SMA actuator fatigue life, is low: the surface is locally smooth. The surface roughness at the larger scale 16, is conversely relatively rougher, to enable a selected, relatively high degree of energy damping. With this combination of different degrees of surface roughness at differing size scales, the SMA structure can simultaneously possess operational characteristics that are conventionally in opposition. Thus, a range of SMA structure characteristics, including damping, can be addressed by controlling the shape and character of the structure's surface by appropriate surface modification technique.

This control of surface roughness or smoothness is generally applicable to any SMA structure provided that the length of one or more structural features of the structure is within the size regime in which the mechanical properties of the structure are surface-dominated in the manner defined above. Any SMA morphology can be employed, including single crystalline SMA structures, polycrystalline SMA structures, and other SMA morphologies. For example, oligocrystalline SMA structures, defined herein as having a larger surface area than internal grain boundary area, can also be employed, e.g., with a bamboo structure, as described below.

For these various morphologies, any in a wide range of SMA systems showing superelasticity and/or shape memory properties can be employed with the surface control methodology herein. In general, the selected SMA material preferably is characterized by a phase transformation between austenite and martensite that is reversible. In addition, for many applications, it can be preferred to distinguish between nickel-titanium alloys, also known as Nitinol or Ni—Ti, and alloys that are not based on nickel and titanium, such as Cu—Al—Ni, Cu—Zn—Al, Cu—Al—Be, Fe—Mn—Si, Ni—Mn—Ga and others. In Ni—Ti alloys the martensitic phase transformation is between the high temperature austenite phase having a B2 crystal structure and belonging to the Pm3m space group and the low temperature martensite phase having a B19 crystal structure and belonging to the $P_{21}/m$ space group. While other shape memory alloy systems also transform from austenite to martensite, the martensite phase, and often the austenite phase as well, belong to a crystal structure and space group that are different than that of Ni—Ti.

For many applications, it can be preferred to employ the surface control methodology herein with an alloy system having a transformation other than the Ni—Ti B2 austenite to B19' martensite transformation. Alloy systems characterized by other transformations, including those having a B2 austenite structure and a martensite structure that is not B19' with space group $P_{21}/m$ can be preferred. The austenite phase in alloy systems other than Ni—Ti is often cubic, such as $L_{21}$, $D_{O3}$ or B2 or others, with space groups Fm3m, Pm3m or others. Table I below provides a list of example martensite crystal structures, in Ramsdell notation, and example space groups of martensite crystal structures of alloys that can be preferred for the surface conditioning methodology herein.

TABLE I

| Martensite Crystal Structure | Martensite Space Group |
|---|---|
| 2H | Pnmm |
| $18R_1$ | A2/m |

TABLE I-continued

| Martensite Crystal Structure | Martensite Space Group |
|---|---|
| M18R | Im3m |
| 6R | A2/m |

Table II below provides a listing of many example SMA materials that are well-suited for the surface conditioning methodology and that do not transform from austenite to the B19' martensite crystal structure belonging to the $P2_1/m$ space group. In addition, it can be preferred, for many applications, to employ an SMA material that is characterized by a composition that includes at least about 10 wt. % Cu or alternatively, an SMA material composition that includes at least about 5 wt. % of one or more of the elements Fe, Au, Ag, Al, In, Mn, and Co. In other words, for some applications, it can be preferred that the SMA composition include at least one of Cu in at least about 10 wt. %, Fe in at least about 5 wt. %, Au in at least about 5 wt. %, Ag in at least about 5 wt. %, Al in at least about 5 wt. %, In in at least about 5 wt. %, Mn in at least about 5 wt. %, Zn in at least about 5 wt. % and Co in at least about 5 wt. %.

TABLE II

| ALLOY | COMPOSITION (atomic %) |
|---|---|
| Ag—Cd | 44-49 Cd |
| Au—Cd | 46.5-48.0 Cd |
| Au—Cd | 49-50 Cd |
| Cu—Zn | 38.5-41.5 Zn |
| Cu—Sn | 14-16 Sn |
| Cu—Zn—X, with X = Si, Sn, Al, Ga | A few at % |
| Cu—Al—Ni | 28-29 Al, 3.0-4.5 Ni |
| Cu—Al—Mn | 16-18 Al, 9-13 Mn |
| Cu—Au—Zn | 23-28 Au, 45-47 Zn |
| Cu—Al—Be | 22-25 Al, 0.5-8 Be |
| In—Tl | 18-23 Tl |
| In—Cd | 4-5 Cd |
| Mn—Cd | 5-35-Cd |
| Fe—Pt | 25 Pt |
| Fe—Ni—Co—Ti | 23 Ni, 10 Co, 10 Ti |
| Fe—Ni—Co—Ti | 33 Ni, 10 Co, 4 Ti |
| Fe—Ni—Co—Ti | 31 Ni, 10 Co, 3 Ti |
| Fe—Ni—C | 31 Ni, .4 C |
| Fe—Ni—Nb | 31 Ni, 7 Nb |
| Fe—Mn—Si | 30 Mn, 28-33 Mn, 4-6 Si |
| Fe—Cr—Ni—Mn—Si | 9 Cr, 5 Ni, 14 Mn, 6 Si |
| Fe—Cr—Ni—Mn—Si | 13 Cr, 6 Ni, 8 Mn, 6 Si |
| Fe—Cr—Ni—Mn—Si | 8 Cr, 5 Ni, 20 Mn, 5 Si |
| Fe—Cr—Ni—Mn—Si | 12 Cr, 5 Ni, 16 Mn, 5 Si |
| Fe—Mn—Si—C | 17 Mn, 6 Si, 0.3 C |
| Fe—Pd | 30 Pd |

Whatever SMA alloy composition is selected to be employed with the surface conditioning methodology, the material is provided with at least one structural feature having an extent, or size, that is within the length scale determined for the SMA material to be characterized as the surface-dominated size regime. This size regime can be imposed on the structure in any suitable fashion for a desired SMA application, and no particular structural feature arrangement or configuration is required. An SMA structure having controlled surface finish can take any suitable form, and is not limited to the example wire structure described above. The SMA structures are not limited to a particular morphology, and can exhibit an oligocrystalline, polycrystalline, or monocrystalline microstructure. For any morphology, and referring to FIGS. 3A-3E, FIGS. 4A-4E, and FIGS. 5A-5C, the SMA material can be employed in the fabrication of a structure having a feature such as a wire or wire-like rod, as in FIGS. 3A-3B, having a diameter, d, within the surface-dominated size regime. Any morphology can be employed, but if the material is polycrystalline, there can be imposed an additional constraint requiring that the diameter, d, be no larger than the extent of a polycrystalline grain 20 of the structure. As shown in FIG. 3B, this results in the oligocrystalline bamboo structure in which grains generally spanning the diameter of the wire are configured along the length of the wire.

Turning to FIG. 3C, there is shown an example of a SMA structure provided in the configuration of a superelastic alloy film, a layer, or a planar structure 28. The planar structure 28 is characterized by a thickness, t, that is produced to be within the size regime for surface-dominated energy dissipation by the planar structure. This thickness of the planar structure can be further controlled, if desired, to be no larger than the extent of a grain 20 of the structure, whereby grains generally span the entire thickness of the structure.

In FIG. 3D there is shown a further example of suitable SMA structure, here in the configuration of superelastic alloy open cell foam 30 having struts throughout the foam; similarly a closed cell foam can be employed. The span, w, of an individual cell strut is produced to be within the size regime for surface-dominated energy dissipation by the SMA structure. The span further can be specified to be no larger than the extent of a grain 20 of the structure, whereby grains generally extent across the entire strut span of the foam. In FIG. 3E, there is shown a further example of a suitable SMA structure, here in the configuration of a superelastic alloy tube 29 having a tube wall thickness, x. The wall thickness, x, of the tube is produced to be within the size regime for surface-dominated energy dissipation by the SMA structure. The wall thickness further can be produced to be no larger than the extent of a grain 20 of the structure, whereby grains generally span the entire thickness of the tube wall, if desired for a selected application.

Figure 4A:
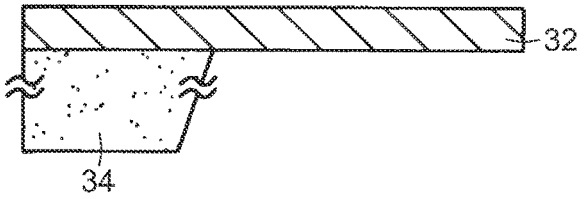
FIGS. 4A-4E are schematic views of an example superelastic alloy cantilever, membrane, bridge, ribbon, and vertical wall, respectively, having surfaces that can be modified as provided herein.
Figure 4B:
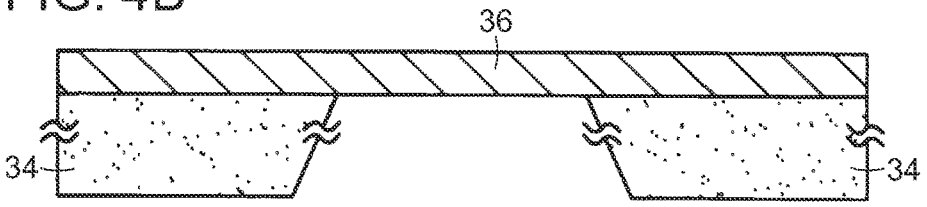
Figure 4C:
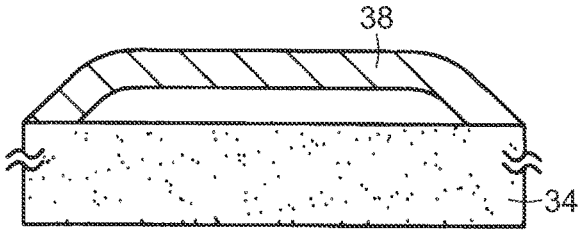
Figure 4D:
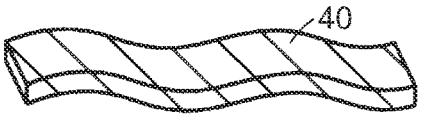
Figure 4E:
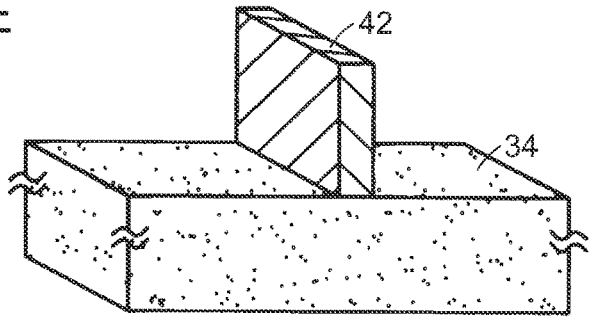

SMA structures can be configured with a wide range of superelastic alloy structural elements in any suitable manner to produce a desired structure arrangement for a given application and with surface conditioning of the structure. For example, referring to FIG. 4A, a planar SMA alloy structure can be configured as a cantilever beam 32 supported on a substrate 34. As shown in FIG. 4B, a planar alloy structure can be configured as a free standing, self-supported plate or membrane 36 supported at the membrane edges by a substrate 34. Alternatively, an arching bridge-like alloy surface structure 38 can be provided on a support or substrate 34. Other configurations, like that in FIG. 4D, such as an alloy ribbon 40 that is free to be disposed or incorporated into a structure, can be produced in a SMA structure. Referring to FIG. 4E, a planar alloy structure 42 can also be arranged vertically relative to a substrate 34 or other structure. In each of the example structures of FIG. 4, one feature, such as beam, membrane, bridge, or ribbon thickness, is within the size regime specified for surface-dominated energy damping by the structure.

In general, SMA structural elements and geometrical features that are not within the surface-dominated energy damping size regime can also be included in the SMA structure, and features that are not superelastic can also be included and incorporated into the structure. Such non-superelastic elements can be in contact with or connected to the superelastic alloy in any suitable configuration that enables phase transformation of the superelastic alloy. In addition, two or more distinct compositions of superelastic alloy can be included in the structural configuration.

Figure 5A:
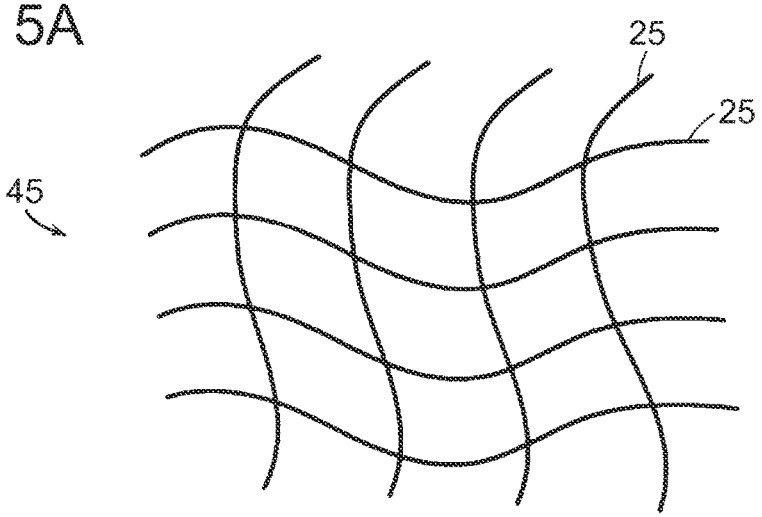
FIGS. 5A-5C are schematic views of an example weave of superelastic alloy fibers, bundle of superelastic alloy fibers, and braid of superelastic alloy fibers, respectively, having surfaces that can be modified as provided herein.
Figure 5B:
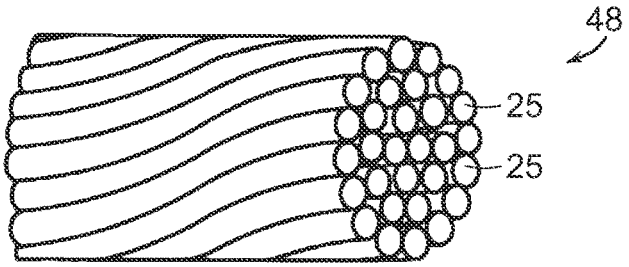
Figure 5C:
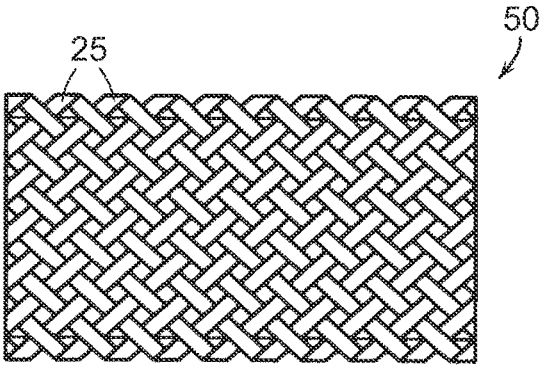

SMA fibers or wires can similarly be configured in any suitable arrangement for surface conditioning to achieve a selected energy damping. Referring to FIG. 5A, superelastic alloy wire or fiber 25 can be woven into a fiber sheet 45 to form a SMA structure that is a woven sheet of layer that can be employed, e.g., as a fiber textile in the manner of fabric. Such alloy wires or fibers can be bundled, as shown in FIG. 5B, in a cable or bundle 48 of fibers 25 that are twisted, braided, intertwined, or otherwise configured within the bundle for a selected application, including coaxial arrangements. As shown in FIG. 5C, fibers or wires 25 can be braided in a braiding configuration 50 for producing a braided sheet, tube or other configuration of wires or fibers. The weave or braid in such a configuration can be two-dimensional, or can be characterized by any suitable multi-dimensional weave or braid in the directionality of the build-up of the structure. In such structures comprising more than one individual wire or fiber, one or more of the fibers or wires can be superelastic alloys, with one or more non-superelastic fibers or wires included in the braid or weave. In such a composite arrangement, such as a felts, where SMA wires can be spread in the weave or braid matrix to provide isotropic energy dissipation through the structure. Alternatively, all of the fibers or wires in the structure can be of one or more superelastic alloy compositions.

In the example structures of FIGS. 3, 4, and 5, at least one feature of the structures is characterized by an extent that is within the size regime for surface-dominated energy dissipation during martensitic transformation of the structure. For many applications, this feature size extent is less than about 1 mm and more than about 1 μm; that is, a feature, such as wire diameter, foam strut diameter, film thickness, ribbon thickness, beam or bridge cross-sectional thickness, tube wall thickness, or other feature extent is no greater than about 1 mm and no less than about 1 μm produces feature behavior in the surface-dominated size regime of energy dissipation during a martensitic transformation cycle. For many applications, a feature size extent of less than about 500 μm and more than about 1 μm can be specified to produce feature behavior in the surface-dominated size regime of energy dissipation.

With these material and dimensional specifications, there is selected a SMA material structure and feature geometry to be customized by surface conditioning for producing a selected degree of energy damping. In one example of such, there is provided a superelastic wire of an alloy of Cu—Zn—Al having a wire diameter that is between about 20 μm and about 200 μm, that renders that structure oligocrystalline and in the surface-dominated energy dissipation size regime.

With a selected SMA material arranged in a surface-dominated structural geometry, the surface roughness of the SMA structure can be modified to achieve a surface condition that produces a selected degree of energy damping. The structure can be exposed to any suitable process conditions that achieve a desired surface smoothness, by smoothing or roughening the surface; no particular surface processing is required. The following list recites examples of roughening and smoothing techniques: blanching; mechanical polishing and/or grinding; chemical, electrochemical or mechanical etching, case hardening; ceramic glazing; cladding; corona treatment; diffusion processes such as carburizing or nitriding; electroplating; galvanizing; gilding; glazing; knurling; painting; passivation/conversion coating by, e.g., anodizing, bluing, chromate conversion coating, phosphate conversion coating, parkerizing, or plasma electrolytic oxidation; plasma spraying; powder coating; thin-film deposition of a selected material or materials in a coating or other layer on the surface of the SMA structure, e.g., by chemical vapor deposition (CVD), electroplating, electrophoretic deposition (EPD), mechanical plating, sputter deposition, physical vapor deposition (PVD), vacuum plating, or other deposition process; vitreous enameling; abrasive blasting, such as sand-blasting; burnishing; polishing, such as chemical-mechanical planarization or polishing (CMP) and buffing; electropolishing; flame polishing; gas cluster ion beam processing; grinding; industrial etching; linishing; mass finishing processes such as tumble finishing and vibratory finishing; pickling; peening, such as shot peening; superfinishing, such as magnetic field-assisted finishing; and other suitable surface conditioning processes.

Many of the surface conditioning techniques recited in the list above can be adapted for either roughening or smoothing a SMA structure surface as-desired. For example, the conditions of mechanical polishing with abrasive paper can be adapted for either roughening or smoothing a surface to correspondingly increase or decrease energy damping, respectively. Course abrasive paper, with a relatively low grit number, can be employed in mechanical polishing to increase surface roughness, while fine abrasive paper, with a relatively high grit number, can be employed in mechanical polishing to reduce surface roughness. Similarly, the conditions of surface electropolishing can be adapted to produce either a smooth or rough surface finish. The electropolishing voltage can be controlled to produce conditions that smooth or roughen a surface, and a voltage that is either higher or lower than a particular polishing voltage for a given material can be employed to produce microscopically smooth surfaces with large macroscopic undulations. In this way, a hierarchical surface roughness, as discussed above and shown in FIG. 2, can be produced.

Other surface conditioning techniques further can be customized for surface roughening or smoothing. For example, the conditions of chemical etching can be adapted to either roughen or smooth a surface. While a wide range of chemical etchants render a surface smooth, other chemical etchants roughen a surface, and the SMA structure composition and morphology can be exploited to tailor the effects of chemical etching, e.g., to remove surface defects or to produce surface erosion. These examples demonstrate that a wide range of materials processing techniques can be tailored and adapted to provide a selected degree of SMA surface roughening or surface smoothing in a methodology to control energy damping in an SMA structure having a feature size in the surface-dominated size regime.

With a selected surface conditioning process, the SMA structure surface can be characterized by a degree of surface roughness, e.g., a root mean square surface roughness, $R_q$, and/or an arithmetic average surface roughness, $R_a$. Whatever roughness metric is employed, as explained above the surface roughness can be correlated directly to a corresponding SMA structure energy dissipation during a martensitic transformation cycle. For applications in which low SMA martensitic transformation energy dissipation is called for, a SMA structure surface roughness, $R_q$, that is no greater than about 100 nm, and an arithmetic average surface roughness, $R_a$, that is no greater than about 80 nm, can be preferred. For applications in which a larger energy damping is desired, the surface roughness, $R_q$, can be tuned to a larger value, for example $R_q$ in the range of about 100 nm-150 nm, about 150 nm-200 nm, about 200 nm-250 nm, about 250 nm-300 nm, about 300 nm-400 nm, about 400 nm-500 nm, about 500 nm-1000 nm, or larger. Conversely, for applications requiring a more smooth SMA structure surface to achieve a lower energy damping, an average surface roughness, $R_a$, in the range of about 10 nm-50 nm, about 50 nm-80 nm, about 80 nm-100 nm, about 100 nm-200 nm, about 200 nm-500 nm, about 500 nm-1000 nm can be deemed desirable. As the surface roughness is increased, the amount of damping that is achieved during a martensitic transformation cycle increases, and can be correspondingly tuned to the degree that is required for a particular application.

The surface conditioning methodology thereby can be implemented in the design and manufacturing of a wide variety of applications, including sensing and actuation, superelastic movement, and energy damping, e.g., for medical devices, smart fabrics, and sensing. The following list provides a number of examples in which an SMA structure having a feature in the surface-dominated size regime can be engineered by the surface conditioning methodology to attain a requisite degree of energy dissipation, and is not limiting: medical devices, such as insulin pumps, drug release devices, guides for catheters through blood vessels, steerable medical instruments like guide wires and guide pins, bone suturing anchors, suture retrievers, remote suturing or stapling and steering devices, stents, pulmonary embolism filters, and gall stone collectors, orthotics, orthodontic bridge wires and endodontic files; actuators, including applications conventionally addressed by piezoelectric materials, and for, e.g., watch springs, human-like muscle for robots, fuel injector actuators, eyeglass frames, head phones, shoes, e.g., as shoe inserts, fishing rods and fishing line shock leaders, sports equipment such as golf club shafts, helmets, and rackets, automotive radiators, air conditioners, e.g., as flap actuators, grill louvers for HVAC systems, rear view mirrors, toy and greeting card motion actuators, solar concentrator actuators, utility line snow and ice relief pulse actuators, drone control actuation, adaptive helicopter blade actuation, variable-geometry chevrons for jet engines, and mechanical actuation work, such as rock breaking; temperature sensors and temperature switches e.g., for cooking applications and thermal applications such as nuclear plant safety sensing and actuation, window and window blind sensing and actuation, anti-scalding sensors, fire sensors and sprinkler actuation, and thermal-control for electrical current interrupters; desiccator sensors and actuators, mechanical closures and latches, e.g., latch releases, e.g., for mechanical structures such as computers and tablets, or ejector actuators, such as an ejector for a computer card or disc; mechanical control structures, such as for seat belt tighteners, gas mask deployment, camera focus and image stabilization, and touch-based communication, such as for computer and phone haptics, e.g., in vibration control and feedback, as in engine mount vibration control, earthquake damping in bridges and buildings, cell phone camera voice coil damping springs, cell phone antenna, and active or passive drive train vibration control; micromotion as a micromotor, e.g., for applications such as consumer disposable devices like toothbrushes and razors; wearable electronics and clothing such as self-heating apparel, hat rims, and brassiere underwires; fasteners and couplers, such as satellite release bolts, pipe couplings, pumps and valves, e.g., in microfluidic applications such as microcircuit and LED cooling; pumps and valves, e.g., for oil, gas, or water pumps, and blowout prevention valves for oil and gas wells; and energy dissipation, e.g., in body armor, in automotive frames, e.g., for bumper damping and crash absorption, and damping as, e.g., damping felt, in heat engines, in thermoelastic cooling, and for other damping, e.g., acoustic damping.

Figure 6:
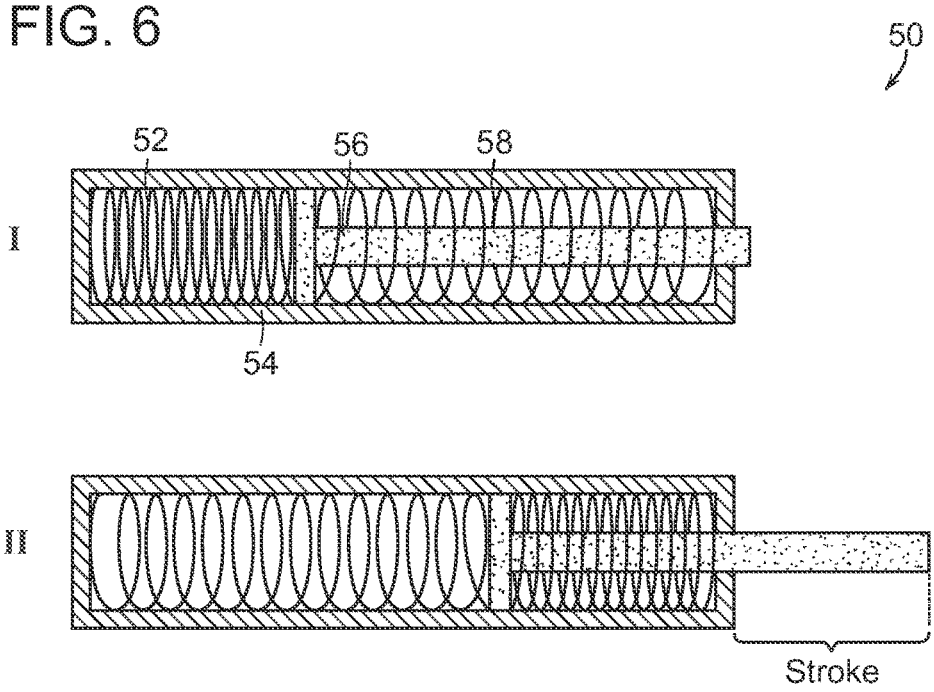
FIG. 6 is a schematic view of a spring actuator including an SMA spring element having a surface smoothness for long actuation fatigue life.

FIG. 6 illustrates schematically an example SMA actuator 50 for which the surface conditioning methodology can be employed to produce a desired degree of energy damping. The example SMA actuator 50 is configured as an SMA ribbon, wire or similar structure 52 that is disposed in a spring configuration in an actuation casing 54 having a piston 56 for producing a linear stroke. A bias spring 58 is provided in the casing and can consist of any suitable metal or polymer, designed with an appropriate stiffness. In a first condition (I), the SMA spring structure 52 is not activated, and is in the martensitic phase. In a second condition (II), the SMA spring structure 52 has been activated by an activation stimulus, and is now in the austenitic phase. With this phase transformation, the SMA spring produces a stroke of the piston 56. For this application, in which high fatigue life can be desired, and energy dissipation is not in general required, the surface of the SMA wire is processed to be relatively smooth and thereby to not dissipate damping energy to a large degree.

Figure 7:
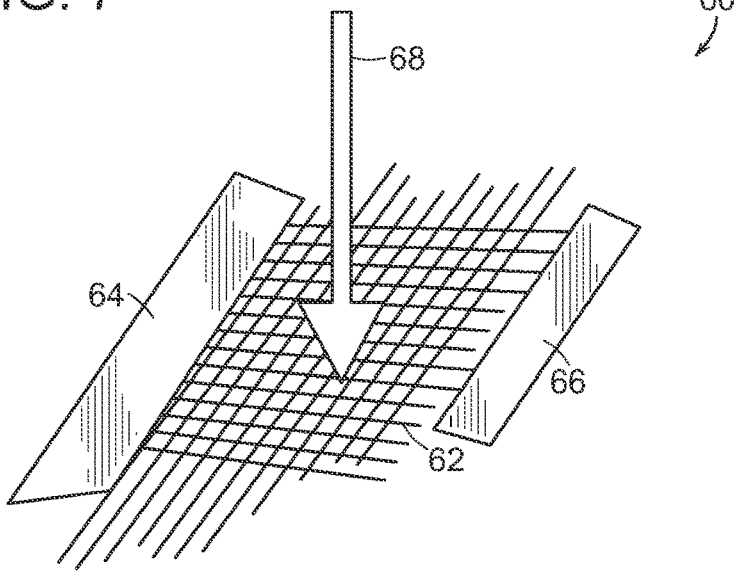
FIG. 7 is a schematic view of a energy damping structure including SMA wires have surface roughness for damping energy.

FIG. 7 schematically illustrates a contrasting example SMA device configuration 60 for which a relatively large degree of energy damping can be desired, here for vibration control. The configuration here includes a two-dimensional arrangement of SMA wires 62 that are woven or otherwise together arranged, e.g., as a fabric or other layer, and that are connected between, e.g., structural supporting members 64, 66. If a force 68 having at least one force component that is parallel to the plane of the woven arrangement is exerted against the structure 60, e.g., by an object such as an engine, ball, vehicle, person, bullet or other physical object, the wires 62 of the configuration 60 stretch and at least partially undergo a martensitic phase transformation, dissipating energy during the transformation. For this application, in which energy dissipation is preferred, the surface of the SMA wire is processed to be relatively rough, to thereby enhance damping of mechanical energy in the configuration of woven wires.

These examples demonstrate that any suitable stimulus input can be employed for causing the phase transformation in an SMA structure for which a conditioned surface is provided. In general, the phase transformation can be initiated by application of stress to a given SMA structure that is above the transformation temperature of the SMA. The temperature differential between the activated and non activated state of the structure is preferably greater than about 2° C. In one example, the temperature range in which an oligocrystalline SMA structure can cyclically transform and be activated is between about −200° C. and about +250° C.

But martensitic transformation can be induced by exposure of the SMA structure to thermal, magnetic, electromagnetic, or other suitable stimulus environment. For example, a SMA structure can be actuated thermally, by temperature control of a vapor or fluid atmosphere surrounding the structure. Alternatively, an SMA structure transformation can be activated by passing electricity through the structure to cause heating of the structure. Additionally, martensitic transformation can be triggered by the application of a magnetic field to the structure to produce a magnetic transformation hysteresis cycle. Both thermal and the magnetic transformation hysteresis damping cycles are related to the energy dissipation of the cycles in the manner of stress hysteresis being related to superelastic cycle transformation. In all cases, the energy that is dissipated during a cycle transformation is controlled by surface conditioning of a SMA structure having a feature size that is in the surface-dominated size regime.

EXAMPLE

Several samples of Cu—Zn—Al oligocrystalline wire with rough and smooth surfaces were produced using the following method. Solid pieces of shape memory alloy with the composition Cu-22.9Zn-6.3Al (wt. %) were placed in an aluminosilicate glass tube that had a 4 mm inner diameter and a working temperature of ~1250° C. The inside of the tube was subjected to low vacuum conditions and an oxy-acetylene burner was used to heat the glass/metal until the metal melted and the glass softened. The softened glass capillary, with molten metal at its core, was then drawn out of the hot zone of the burner, reducing the capillary diameter and hardening the capillary. The result after this drawing process was a glass-coated metallic fiber having a diameter of 80 μm. The fiber was annealed at 800° C. in an argon atmosphere for 3 h and water quenched. During the annealing the grains grew to span the wire cross section, forming a bamboo grain structure, and meeting the criterion for oligocrystallinity.

After annealing, the glass coating was removed by immersion in ~10% diluted aqueous hydrofluoric acid. The surface of the wire after glass removal was observed to be rather rough, with features reminiscent of valleys running parallel to the wire axis. The wires were electropolished in an electrolyte consisting of 67% phosphoric acid and 33% deionized water, by volume, for 30-120 s depending on wire size. The electrolyte was stirred at 80 rpm using a magnetic stir bar to produce circular flow of the electrolyte. Two pure Cu electrodes were submerged in the electrolyte with the wire and connected in a circuit with a power supply in which the voltage could be controlled and the current measured. A polishing voltage of 2.8 V was set for the polishing process. One electrode, designated as the anode, was arranged with an end of the SMA wire attached thereto by conducting copper tape. The wire was oriented along the flow lines of the electrolyte. The other electrode, designated as the cathode was provided with a larger surface area than the anode. With this polishing configuration, the power supply was turned on for about 1 minute.

After electropolishing, the rough features of the as-drawn wire were removed; the surface was smooth and the wire diameter was uniform. Differential scanning calorimetry (DSC) of a polished wire with diameter 65 μm determined that the martensitic transformation temperatures for the wire were $A_f$~25, $A_s$~9, $M_s$~8 and $M_f$~−6° C.

Figure 8A:
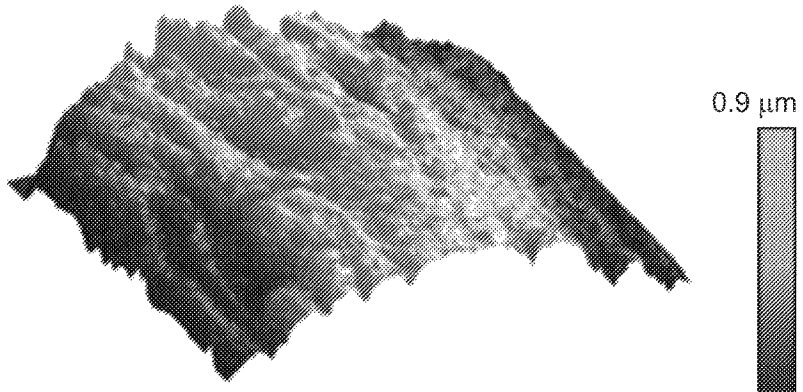
FIGS. 8A-8B are atomic force microscopy scans showing the surface topography of a SMA wire with a large surface roughness and a smooth surface finish obtained after surface polishing.
Figure 8B:
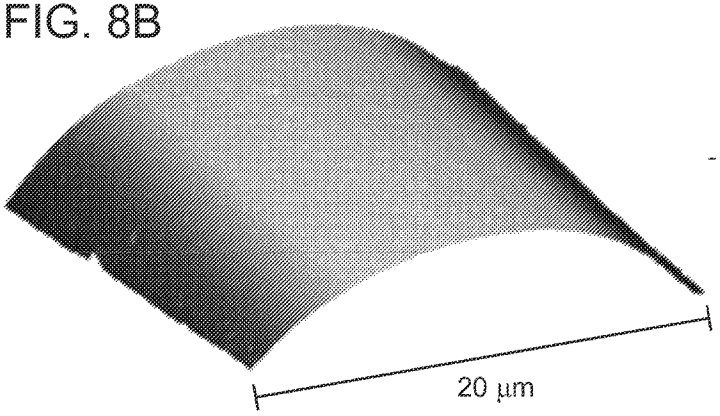

FIGS. 8A-8B are atomic force microscopy (AFM) topography images of the wire before and after polishing, respectively. Valleys running parallel to the wire axis characterize the unpolished wire. The polished wire, shown in FIG. 8B, exhibits a smooth surface in which the roughness associated with processing is removed. To obtain quantitative measures of surface roughness there were determined the root mean square surface roughness, $R_q$, and the arithmetic average surface roughness, $R_a$, calculated after subtracting the wire curvature using a first order flattening, based on the topography measurements in the conventional manner. The root mean square surface roughness parameter $R_q$, was found to be 10 nm and 125 nm for the polished and unpolished wires, respectively. The arithmetic average roughness parameter, $R_a$, was calculated to be 7 nm and 88 nm for the polished and unpolished wires, respectively To investigate the role of surface roughness on energy damping during martensitic SMA transformation, one of the as-drawn wires was cut into two halves and one half was electropolished as-above. The diameter of the unpolished wire (rough surface) was 80 μm and that of the polished wire (smooth surface) was 41 μm, due to the removal of surface layers. Both of these wire diameters are in the surface-dominated feature size regime, as shown in the plot of FIG. 1A. The mechanical properties of the wire are therefore understood to be surface effect-dominated.

These two wires were then tested in tension at 35° C. in a dynamic mechanical analyzer, the DMA Q800 instrument from TA Instruments, New Castle, Del., operated in load control at a loading rate of 10 MPa·min$^{-1}$ during transformation. The gauge lengths were 8.2 and 5 mm for the polished and unpolished wires, respectively.

Figure 9A:
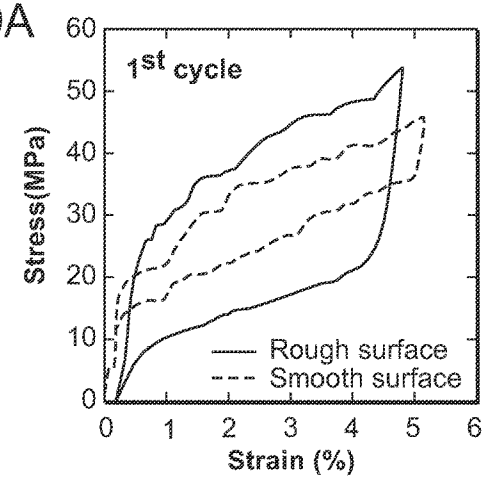
FIGS. 9A-9B are plots of experimentally-measured stress-strain curves for a SMA wire having a rough surface and an SMA wire having a smooth surface, for a first martensitic transformation cycle and a tenth martensitic transformation cycle, respectively.

FIG. 9A provides plots of the measured superelastic stress strain curves of the rough and smooth wires for a first martensitic transformation cycle, i.e., the wire was not previously deformed. The slopes of the transformation plateaus are similar, at about 600 MPa, but the forward plateau is at a higher stress and the reverse plateau is at a lower stress for the rough wire compared to the smooth wire. The stress to induce martensite was about 26 MPa and 20 MPa for the rough and the smooth wires, respectively, and the rough wire shows a much larger hysteresis size than the polished wire. The strain-averaged vertical hysteresis sizes were 21.5 MPa and 8.5 MPa for the rough and polished wires, respectively; the energy dissipation of the two wires differ by a factor of 2.5. This demonstrates that the energy dissipated during martensitic transformation of the experimental wire could be controlled, here reduced by a factor of 2.5, by smoothing the surface of the wire.

Figure 9B:
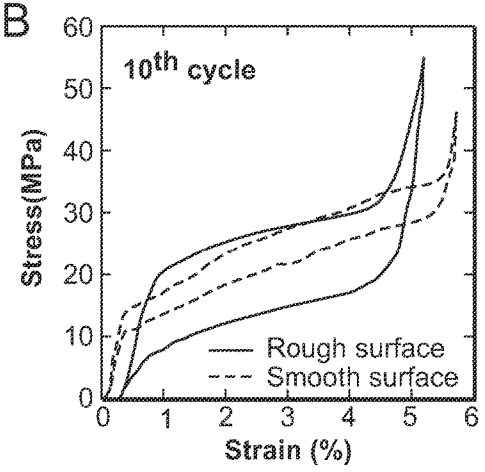

The properties of Cu—Zn—Al and many other SMAs evolve over the course of multiple martensitic cycles before reaching a somewhat stable response after about ten cycles. FIG. 9B provides plots of the measured superelastic transformation curves for the rough and smooth wires during a tenth cycle of transformation, for which it is understood that the curves reached a steady state. Interestingly, the forward plateaus are now similar; however, the difference between the two reverse plateaus is still large. In fact, the degree of energy dissipation still differs by a factor of 2.5, given that the hysteresis sizes are now 11.3 MPa and 4.7 MPa for the rough and the polished samples, respectively.

The gauge sections of these two wire samples were estimated to be about 40 grains and 65 grains, for the rough and polished wires, respectively, and it is therefore understood that factors such as grain size and orientation played only minor roles in affecting the dramatic distinction in the measured SMA properties. Furthermore, given that both samples were cut from the same wire, the composition and internal microstructure, e.g. dislocation density, are assumed to be similar. Lastly, as demonstrated in the plotted regimes shown in FIG. 1A, given similar surface roughness, smaller wires in the surface-dominated size regime can exhibit larger hysteresis than larger wires, because such wires have a higher surface-to-volume ratio and therefore more surface area. This size effect can be attributed to increased sampling of obstacles at the wire surface by the austenite/martensite interface. Thus, it is especially suggestive that although the diameter of the polished wire is finer, due to the removal of surface layers by the electropolishing step, this sample still dissipates less energy per unit volume than does the rough wire. After ruling out microstructural and compositional differences as well as size effects, it is concluded that the difference in hysteresis between the two wires is attributable to the difference in surface roughness.

With this description, it is demonstrated that for a SMA structure that includes a feature having a size in a surface-dominated size regime defined for the SMA material of the structure, the amount of energy dissipation during martensitic phase transformation can be controlled by controlling the roughness of the surface of the structure. The surface control methodology provides a practical way to optimize the transformational performance of functional materials, without compromising other properties, and is suitable for a wide range of materials for obtaining performance results such as enhanced fatigue performance.

It is recognized, of course, that those skilled in the art may make various modifications and additions to the embodiments described above without departing from the spirit and scope of the present contribution to the art. Accordingly, it is to be understood that the protection sought to be afforded hereby should be deemed to extend to the subject matter claims and all equivalents thereof fairly within the scope of the invention.

We claim:

1. A method for producing an energy damping-controlled shape memory alloy wire comprising:

forming a polycrystalline shape memory alloy wire from an alloy composition that includes at least one member selected from the group consisting of Cu in at least about 10 wt. %, Fe in at least about 5 wt. % Au in at least about 5 wt. %, Ag in at least about 5 wt. %, Al in at least about 5 wt. % In in at least about 5 wt. %, Mn in at least about. 5 wt. %, Zn in at least about 5 wt. % and Co in at least about 5 wt. %, the alloy composition having a martensite crystal structure consisting of one of 2H, $18R_1$, M18SR, and 6R;

annealing the polycrystalline shape memory alloy wire until polycrystalline grains within the wire grow to span a cross sectional wire diameter, transforming the polycrystalline shape memory alloy wire to an oligocrystalline shape memory alloy wire, the oligocrystalline shape memory alloy cross sectional wire diameter being greater than about 1 micron and less than about 500 microns; and electropolishing the oligocrystalline shape memory alloy wire until surface roughness of the oligocrystalline shape memory alloy wire is no greater than about 100 nanometers, to reduce the energy damping characteristic of the oligocrystalline shape memory alloy wire.

2. The method of claim 1 wherein the cross sectional wire diameter has an extent that causes energy dissipation by the oligocrystalline shape memory alloy wire during a martensitic phase transformation to be dominated by surface roughness of the oligocrystalline shape memory alloy wire.

3. The method of claim 1 wherein the oligocrystalline shape memory alloy wire cross sectional diameter is less than about 250 microns.

4. The method of claim 1 wherein the oligocrystalline shape memory alloy wire cross sectional diameter is less than about 100 microns.

5. The method of claim 1 wherein the oligocrystalline shape memory alloy wire cross sectional diameter is greater than about 10 microns.

6. The method of claim 1 wherein the oligocrystailline shape memory alloy wire cross sectional diameter is greater than about 100 microns.

7. The method of claim 1 wherein the alloy composition comprises Cu—Zn—Al.

8. The method of claim 1 wherein the alloy composition comprises Cu-14Al-4Ni (wt. %).

9. The method of claim 1 wherein electropolishing the oligocrystalline shape memory alloy wire comprises submerging the oligocrystalline shape memory alloy wire in an electrolyte with the oligocrystalline shape memory alloy wire oriented along flow lines of the electrolyte.

10. The method of claim 1 further comprising water quenching the the oligocrystalline shape memory alloy wire after annealing.

* * * * *